US008401795B2

(12) United States Patent
Kaageson-Loe et al.

(10) Patent No.: US 8,401,795 B2
(45) Date of Patent: Mar. 19, 2013

(54) METHODS OF DETECTING, PREVENTING, AND REMEDIATING LOST CIRCULATION

(75) Inventors: Nils Kaageson-Loe, Houston, TX (US); Trond Daatland, Stavanger (NO); Oystein Randeberg, Stavanger (NO); Arne Asko, Rege (NO); Frederick B. Growcock, Houston, TX (US); Gabe Manescu, Katy, TX (US); Mark Sanders, Houston, TX (US)

(73) Assignee: M-I L.L.C., Houston, TX (US)

( * ) Notice: Subject to any disclaimer, the term of this patent is extended or adjusted under 35 U.S.C. 154(b) by 418 days.

(21) Appl. No.: 12/363,493

(22) Filed: Jan. 30, 2009

(65) Prior Publication Data

US 2009/0188718 A1 Jul. 30, 2009

Related U.S. Application Data

(60) Provisional application No. 61/024,807, filed on Jan. 30, 2008.

(51) Int. Cl.
*G01V 1/40* (2006.01)
*C09K 8/02* (2006.01)
*E21B 43/16* (2006.01)

(52) U.S. Cl. ..... 702/9; 175/72; 166/305.1

(58) Field of Classification Search ..... 702/9, 1–2, 702/6, 11–14, 50, 81, 84, 138, 182–183; 175/40, 48, 50, 57, 65, 72; 703/5, 9–10; 166/250.1, 259–261, 266, 268–271, 275, 166/282–283, 305.1, 307, 308.1–308.6, 312, 166/369–370

See application file for complete search history.

(56) References Cited

U.S. PATENT DOCUMENTS

| | | | |
|---|---|---|---|
| 2007/0249504 | A1 | 10/2007 | Ballard |
| 2007/0287767 | A1 | 12/2007 | Ballard |

FOREIGN PATENT DOCUMENTS

| | | |
|---|---|---|
| WO | 2008134359 | 11/2008 |
| WO | 2008134371 | 11/2008 |
| WO | 2008147658 | 12/2008 |
| WO | 2008147659 | 12/2008 |
| WO | 2009018536 | 2/2009 |

OTHER PUBLICATIONS

Whitfill et al., New Design Models and Materials Provide Engineered Solutions to Lost Circulation, 2006, SPE 101693, pp. 1-14.*
Whitfill et al., Manage WPC to Maximize Reservoir Deliverability, Jul./Aug. 2005, Drilling Contractor, pp. 59 & 61.*
Adachi et al., Depleted Zone Drilling: Reducing Mud Losses Into Fractures, 2004, IADC/SPE 87224, 11 pp.*
"Optimizing the Selection of Bridging Particles for Reservoir Drilling Fluids", Dick, et al., SPE 58793, Feb. 2000, (pp. 1-8).

* cited by examiner

*Primary Examiner* — Toan Le
(74) *Attorney, Agent, or Firm* — Osha Liang LLP

(57) ABSTRACT

A method for planning a wellbore, the method including defining drilling data for drilling a segment of a planned wellbore and identifying a risk zone in the segment. Additionally, the method including determining an expected fluid loss for the risk zone and selecting a solution to reduce fluid loss in the risk zone. Furthermore, a method for treating drilling fluid loss at a drilling location, the method including calculating a drilling fluid loss rate at the drilling location, classifying the drilling fluid loss based on the drilling fluid loss rate, and selecting a solution based at least in part on the classifying.

20 Claims, 7 Drawing Sheets

METHODS OF DETECTING, PREVENTING, AND REMEDIATING LOST CIRCULATION

CROSS-REFERENCE TO RELATED APPLICATION(S)

This application claims priority, pursuant to 35 U.S.C. §119(e), of U.S. Provisional Application Ser. No. 61/024,807, filed on Jan. 30, 2008, and is hereby incorporated by reference.

BACKGROUND OF INVENTION

1. Field of the Invention

Embodiments disclosed herein relate generally to lost circulation experienced during drilling a wellbore. In particular, embodiments disclosed herein relate to the detection, classification, and remedial treatment of lost circulation occurrences. Additionally, embodiments disclosed herein also relate to the anticipation of lost circulation during wellbore planning and preventative treatments to minimize the occurrences of such lost circulation.

2. Background Art

During the drilling of a wellbore, various fluids are typically used in the well for a variety of functions. The fluids may be circulated through a drill pipe and drill bit into the wellbore, and then may subsequently flow upward through the wellbore to the surface. During this circulation, the drilling fluid may act to remove drill cuttings from the bottom of the hole to the surface, to suspend cuttings and weighting material when circulation is interrupted, to control subsurface pressures, to maintain the integrity of the wellbore until the well section is cased and cemented, to isolate the fluids from the formation by providing sufficient hydrostatic pressure to prevent the ingress of formation fluids into the wellbore, to cool and lubricate the drill string and bit, and/or to maximize penetration rate.

As stated above, wellbore fluids are circulated downhole to remove rock, as well as deliver agents to combat the variety of issues described above. Fluid compositions may be water- or oil-based and may comprise weighting agents, surfactants, proppants, and polymers. However, for a wellbore fluid to perform all of its functions and allow wellbore operations to continue, the fluid must stay in the borehole. Frequently, undesirable formation conditions are encountered in which substantial amounts or, in some cases, practically all of the wellbore fluid may be lost to the formation. For example, wellbore fluid can leave the borehole through large or small fissures or fractures in the formation or through a highly porous rock matrix surrounding the borehole.

Lost circulation is a recurring drilling problem, characterized by loss of drilling mud into downhole formations. It can occur naturally in formations that are fractured, highly permeable, porous, cavernous, or vugular. These earth formations can include shale, sands, gravel, shell beds, reef deposits, limestone, dolomite, and chalk, among others. Other problems encountered while drilling and producing oil and gas include stuck pipe, hole collapse, loss of well control, and loss of or decreased production.

Lost circulation may also result from induced pressure during drilling. Specifically, induced mud losses may occur when the mud weight, required for well control and to maintain a stable wellbore, exceeds the fracture resistance of the formations. A particularly challenging situation arises in depleted reservoirs, in which the drop in pore pressure weakens hydrocarbon-bearing rocks, but neighboring or inter-bedded low permeability rocks, such as shales, maintain their pore pressure. This can make the drilling of certain depleted zones impossible because the mud weight required to support the shale exceeds the fracture resistance of the sands and silts.

Other situations arise in which isolation of certain zones within a formation may be beneficial. For example, one method to increase the production of a well is to perforate the well in a number of different locations, either in the same hydrocarbon bearing zone or in different hydrocarbon bearing zones, and thereby increase the flow of hydrocarbons into the well. The problem associated with producing from a well in this manner relates to the control of the flow of fluids from the well and to the management of the reservoir. For example, in a well producing from a number of separate zones (or from laterals in a multilateral well) in which one zone has a higher pressure than another zone, the higher pressure zone may disembogue into the lower pressure zone rather than to the surface. Similarly, in a horizontal well that extends through a single zone, perforations near the "heel" of the well, i.e., nearer the surface, may begin to produce water before those perforations near the "toe" of the well. The production of water near the heel reduces the overall production from the well.

During the drilling process muds are circulated downhole to remove rock as well as deliver agents to combat the variety of issues described above. Mud compositions may be water or oil-based (including mineral oil, biological, diesel, or synthetic oils) and may comprise weighting agents, surfactants, proppants, and gels. In attempting to cure these and other problems, crosslinkable or absorbing polymers, loss control material (LCM) pills, gels, and cement squeezes have been employed.

Accordingly, there exists a continuing need for methods and systems for combating lost circulation, in a preventative and/or remedial manner.

SUMMARY OF INVENTION

In one aspect, embodiments disclosed herein relate to a method for planning a wellbore, the method including defining drilling data for drilling a segment of a planned wellbore and identifying a risk zone in the segment. Additionally, the method including determining an expected fluid loss for the risk zone and selecting a solution to reduce fluid loss in the risk zone.

In another aspect, embodiments disclosed herein relate to a method for treating drilling fluid loss at a drilling location, the method including calculating a drilling fluid loss rate at the drilling location, classifying the drilling fluid loss based on the drilling fluid loss rate or pressure in the loss zone, and selecting a solution based at least in part on the classifying.

Other aspects and advantages of the invention will be apparent from the following description and the appended claims.

DETAILED DESCRIPTION

Figure 1:
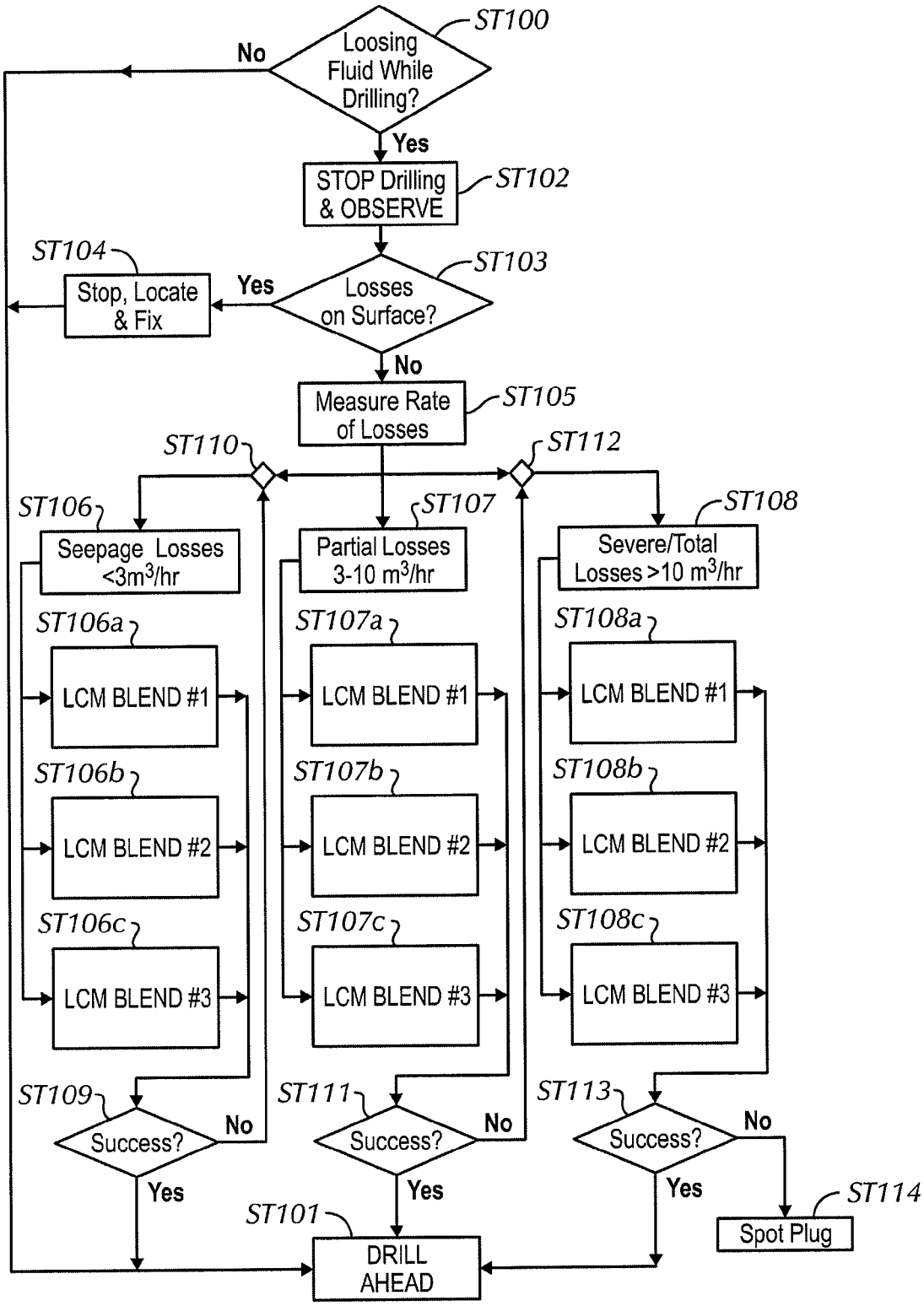
FIG. 1 is a flow chart of a method of remedial lost circulation treatment according to one embodiment of the present disclosure.

In one aspect, embodiments disclosed herein relate generally to lost circulation experienced during drilling of a wellbore. In specific aspects, embodiments disclosed herein relate to the detection, classification, and remedial treatment of lost circulation occurrences. In other specific aspects, embodiments disclosed herein also relate to the anticipation of lost circulation during wellbore planning and preventative treatments to minimize the occurrences of such lost circulation.

Cause and Location of Loss

As described above, lost circulation may be naturally occurring, the result of drilling through various formations such as unconsolidated formations having high permeability, naturally fractured formations including limestone, chalk, quartzite, and brittle shale, vugular or cavernous zones, etc. Appreciation of such types of formation that may be expected in planning a wellbore (or at least segments thereof) and/or encountered during drilling through particular segment(s) of a wellbore may be based on offset well data records that may identify particular formation zones and its characteristics, including for example, lithology, porosity, rock strength, fracture gradient, etc.

Alternatively, lost circulation may be the result of drilling-induced fractures. For example, when the pore pressure (the pressure in the formation pore space provided by the formation fluids) exceeds the pressure in the open wellbore, the formation fluids tend to flow from the formation into the open wellbore. Therefore, the pressure in the open wellbore is typically maintained at a higher pressure than the pore pressure. While it is highly advantageous to maintain the wellbore pressures above the pore pressure, on the other hand, if the pressure exerted by the wellbore fluids exceeds the fracture resistance of the formation, a formation fracture and thus induced mud losses may occur. Further, with a formation fracture, when the wellbore fluid in the annulus flows into the fracture, the loss of wellbore fluid may cause the hydrostatic pressure in the wellbore to decrease, which may in turn also allow formation fluids to enter the wellbore. As a result, the formation fracture pressure typically defines an upper limit for allowable wellbore pressure in an open wellbore while the pore pressure defines a lower limit. Therefore, a major constraint on well design and selection of drilling fluids is the balance between varying pore pressures and formation fracture pressures or fracture gradients though the depth of the well.

A particularly challenging situation arises in depleted reservoirs, in which high pressured formations are neighbored by or inter-bedded with normally or abnormally pressured zones. For example, high permeability pressure depleted sands may be neighbored by high pressured low permeability rocks, such as shale or high pressure sands. This can make the drilling of certain depleted zones nearly impossible because the mud weight required to support the shale exceeds the fracture resistance of the pressure depleted sands and silts.

However, one skilled in the art would appreciate that, in addition to excessive mud weights, such induced fractures may also be partially caused by various drilling techniques or errors. For example, the incorrect placement of casing (too shallow of a placement) may result in an improper mud weight window based on the actual pore-pressure gradient, excessive downhole pressures contributed by any of rapid movement of pipe, excessive pump rates and velocities, improper hole cleaning, etc.

Additionally, when a loss of fluids is experienced, it may be desirable, if possible, to establish or estimate the location of the loss zone, for example, whether the loss zone is at the bottom of the hole, at or near the bottom of the last string of casing, etc. Identifying the location of the loss zone may be particularly desirable so that accurate placement of a treatment pill may occur, and circulation of the drilling fluid may be restored as quickly as possible. Estimation of the loss zone may be based, for example, on surveys known in the art such as spinner surveys, temperature surveys, radioactive tracer surveys, hot wire surveys, pressure transducer surveys, resistivity surveys, etc.

Severity of Loss

Further, the severity of the fluid loss will be related to the cause of the lost circulation, and may be characterized by the pressure within the loss zone and by the rate of fluid loss. The pressure in the loss zone can be estimated based, in part, on the fluid volume added to top-off the well, i.e., the fluid volume required to re-fill the well. Specifically, the pressure within the loss zone may calculated as follows:

$$Pz = \left(Dz - \frac{Vw}{0.25\pi d^2}\right)(MWp)\left(\frac{1}{g}\right) \qquad \text{Eq. 1}$$

where Pz is the pressure of the loss zone (bar); Dz is the true vertical depth (TVD) of the loss zone (m); Vw is the volume of fluid used to top-off well ($m^3$); d is the hole diameter (hole size) in meters (m); MWp is the fluid density inside the drill pipe (SG); and g is gravitational acceleration, 9.81 $m/s^2$. However, in addition to being an indication as to the severity of the loss, the pressure of the loss zone may also be used to indicate the minimum mud weight required for well control. Specifically, until the fracture(s) is sealed, any mud weight in excess of this fluid pressure will result in continued fluid losses. Thus, the static mud density (net wellbore pressure) the zone will support is calculated as follows:

$$MWz = \frac{(Pz)(g)}{Dz} \qquad \text{Eq. 2}$$

where MWz is the mud weight (SG) that the zone will support.

The pressure in the loss zone may be used, for example, to estimate fracture aperture, as described below, and may play a role in determining the mechanism by which fractures are treated, i.e, whether a fracture is plugged/sealed, bridged or filled. The mechanism and effectiveness of the fracture treatment may be used to determine whether and to what extent overbalance conditions may be sustained.

Additionally, the severity may also be classified by the rate at which the fluid is being lost. Specifically, loss rates may be classified into general categories of seepage loss (less than 3 $m^3$/hr), partial loss (3-10 $m^3$/hr) where some fluid is returned to the surface, and severe to total loss (greater than 10 $m^3$/hr) where little or no fluid is returned to the surface through the annulus. Seepage losses often take the form of very slow losses, which may be in the form of filtration to a highly permeable formation, and can often mistakenly be confused with cuttings removal at the surface. Due to the low amounts of fluids lost with seepage losses, it may be determined that drilling ahead with the seepage losses is the most desirable course of action, if within operational limits and if within budget considerations for the fluid loss.

However, partial losses are greater than seepage losses, and thus the cost of the fluid becomes more crucial in the decision to drill ahead or combat the losses. Drilling with partial losses may be considered if the fluid is inexpensive and the pressures are within operating limits. Severe to total losses, on the other hand, typically almost always requires regaining circulation and treatment of the losses.

Estimating Fracture Aperture

The fracture width may either be calculated using drilling parameters and rock properties or estimated from the rate of fluid losses and the hydraulic pressure in the loss zone. For example, fracture gradient, Young's modulus, Poisson's ratio, well pressure, and hole size may be at least used to estimate the width of fractures, which may be done in pre-well planning or following loss occurrences. Such determinations may be made based on conventional fracture models known in the art, including modified Perkins-Kern-Nordgren (PKN) & Geertsma-de Klerk-Khristianovic (GdK) based fracture models. Once losses have occurred, however, one skilled in the art would appreciate that urgency may prevent precise calculation of the fracture apertures from the rock and well properties, and instead an estimation may be performed.

Fluid Loss Control Mechanisms

The result of the type, quantification, and analysis of losses, formation/fracture type, and pressures within the loss zone may be then used to decide the type of curing method to be used. Lost circulation treatments fall into two main categories: low fluid loss treatments where the fracture or formation is rapidly plugged and sealed; and high fluid loss treatments where dehydration of the loss prevention material in the fracture or formation with high leak off of a carrier fluid fills a fracture and/or forms a plug that then acts as the foundation for fracture sealing. The mechanism by which fluid loss is controlled, i.e., plugging, bridging, and filling, may be based on the particle size distribution, relative fracture aperture, fluid leak-off through the fracture walls, and fluid loss to the fracture tip.

In a low fluid loss treatment, a preliminary treatment may include a particulate-based treatment whereby the particles may enter the throat of a fracture, plug or bridge and seal the fracture. Conversely, high fluid loss treatments may operate by filling the fracture with particles. For particulate based treatments, the difference between such treatments is largely based on the particle sizes and particle sizes distribution in comparison to the fracture aperture, which may be calculated or estimated as discussed above.

For low fluid loss, particle-based treatments, a treatment blend solution may be based on a particle size distribution that follows the Ideal Packing Theory is designed to minimize fluid loss. Further discussion of selection of particle sizes required to initiate a bridge may be found in SPE 58793, which is herein incorporated by reference in its entirety. In order to achieve plugging or bridging, a particulate treatment may be selected based on particle type(s), particle geometry (s), concentration(s), and particle size distribution(s) so that coarse or very coarse particles plug or bridge the mouth of the fracture (or the oversized pores of the high permeability formation), and finer particles may then form a tight filtercake behind the bridging particles, thus affecting a seal and fluid loss control. However, in addition to such particulate based treatments, depending on the classified severity of loss, a reinforcing plug, including cement- or resin-based plugs, may be necessary to seal off the fracture.

Conversely, for high fluid loss treatments, particulate based treatments typically use a relatively narrow (uniform) particle size distribution, with medium or fine particles, in order to promote fluid loss. Use of such particles may allow for the material to enter into and be deposited in the fracture by a process of dehydration as the carrier fluid in the LCM treatment leaks-off into the formation. High fluid loss treatments are typically only be used in high permeability formations or fractured formations where there already is a pre-existing high fluid loss, in the reservoir section, shallow poorly consolidated sands or carbonate lithologies.

LCM Material Selection

LCM treatments may include particulate- and/or settable-based treatments. The various material parameters that may be selected may include 1) material type in accordance with considerations based on drilling fluid compatibility, rate of fluid loss, fracture width, and success of prior treatments, etc., 2) the amount of treatment materials, in accordance with the measured or anticipate rate of fluid loss, and 3) particle size and particle size distribution, in accordance with pressure levels, formation type, fracture width, etc.

Particulate-based treatments may include use of particles frequently referred to in the art as bridging materials. For example, such bridging materials may include at least one substantially crush resistant particulate solid such that the bridging material props open and bridges or plugs the fractures (cracks and fissures) that are induced in the wall of the wellbore. As used herein, "crush resistant" refers to a bridging material is physically strong enough to withstand the closure stresses exerted on the fracture bridge. Examples of bridging materials suitable for use in the present disclosure include graphite, calcium carbonate (preferably, marble), dolomite ($MgCO_3.CaCO_3$), celluloses, micas, proppant materials such as sands or ceramic particles and combinations thereof. Further, it is also envisaged that a portion of the bridging material may comprise drill cuttings having the desired average particle diameter in the range of 25 to 2000 microns.

The concentration of the bridging material may vary depending, for example, on the type of fluid used, and the wellbore/formation in which the bridging materials are used. However, the concentration should be at least great enough for the bridging material to rapidly bridge or plug the fractures (i.e., cracks and fissures) that are induced in the wall of the wellbore, but should not be so high as to make placement of the fluid impractical. Suitably, the concentration of bridging material in the pill should be such that the bridging material enters and bridges or plugs the fracture before the fracture grows to a length that stresses are no longer concentrated near the borehole. This length may be optimally on the order of one-half the wellbore radius but may, in other embodiments, be longer or shorter. In one embodiment, the concentration of bridging particles may be carried at an overly high concentration to ensure that appropriately sized particles do bridge or plug and then seal the fracture before the fracture grows in length well beyond the well. Further, such concentrations of bridging agents suitable to bridge or plug and then seal or fill a fracture may be further dependent on the rate of fluid loss. Thus, for seepage losses, to ensure a sufficiently high concentration, in some embodiments, the concentration of bridging particles may be a minimum of 80 $kg/m^3$, whereas for partial losses a minimum concentration of 150 $kg/m^3$ may be used, and a minimum concentration of 200 $kg/m^3$ for severe to total losses. However, one skilled in the art would appreciate that such concentrations are simply general guidelines, and that greater amounts may be used depending on where on the continuum between the fluid loss classes the fluid loss rate is measured. In some embodiments, when continuously treating the fluid with discrete, high concentration pills (80 to 200

Kg/m3) the overall concentration of bridging particles in the fluid may be very much lower depending on the pill volume added and the volume of the fluid in the process.

The sizing of the bridging material may also be selected based on the size of the fractures predicted for a given formation. In one embodiment, the bridging material has an average particle diameter in the range of 50 to 1500 microns, and from 250 to 1000 microns in another embodiment. The bridging material may comprise substantially spherical particles; however, it is also envisaged that the bridging material may comprise elongate particles, for example, rods or fibers. Where the bridging material comprises elongate particles, the average length of the elongate particles should be such that the elongate particles are capable of bridging or plugging the induced fractures at or near the mouth thereof. Typically, elongate particles may have an average length in the range 25 to 2000 microns, preferably 50 to 1500 microns, more preferably 250 to 1000 microns. The bridging material may be sized so as to readily form a bridge or plug at or near the mouth of the induced fractures. Typically, the fractures that may be plugged or filled with a particulate-based treatment may have a fracture width at the mouth in the range 0.1 to 5 mm. However, the fracture width may be dependent, amongst other factors, upon the strength (stiffness) of the formation rock and the extent to which the pressure in the wellbore is increased to above initial fracture pressure of the formation during the fracture induction (in other words, the fracture width is dependent on the pressure difference between the drilling mud and the initial fracture pressure of the formation during the fracture induction step). In such embodiments where fractures are greater than 5 mm, it may be more desirable to select a settable-based treatment. In a particular embodiment in which a low fluid loss treatment is selected, at least a portion of the bridging material, preferably, a major portion of the bridging material has a particle diameter approaching the width of the fracture mouth. Further, the bridging material may have a broad (polydisperse) particle size distribution; however, other distributions may alternatively be used.

In addition to bridging/plugging/propping open the fractures at their mouths, the bridge may also be sealed to prevent the loss of the bridge/material behind the bridge back into the wellbore. Depending on the material and/or particle size distribution selected as the bridging particles, and the material's sealing efficiency, it may be desirable to also include an optional bridge sealing material with the bridging material. However, one of ordinary skill in the art would appreciate that in some instances, a bridging material may possess both bridging/plugging and sealing characteristics, and thus, one additive may be both the bridging material and the bridge sealing material. Additionally, the use of a broad particle size distribution (and in particular, inclusion of fine bridging particles) may also be sufficient to seal the bridge or plug formed at the mouth of the fracture. However, it may be desirable in other embodiments to also include a sealing material to further increase the strength of the seal. Additives that may be useful in increasing the sealing efficiency of the bridge may include such materials that are frequently used in loss circulation or fluid loss control applications. For example, such bridge sealing materials may include fine and/or deformable particles, such as industrial carbon, graphite, cellulose fibers, asphalt, etc. Moreover, one of ordinary skill in the art would appreciate that this list is not exhaustive, and that other sealing materials as known in the art may alternatively be used. In addition to bridging materials, other loss control materials may include seepage-loss control solids, such as ground pecan and walnut shells, and background LCM, which may include any LCM materials.

Settable treatments suitable for use in the methods of the present disclosure include those that may set or solidify upon a period of time. The term "settable fluid" as used herein refers to any suitable liquid material which may be pumped or emplaced downhole, and will harden over time to form a solid or gelatinous structure and become more resistance to mechanical deformation. Examples of compositions that may be included in the carrier fluid to render it settable include cementious materials, "gunk" and polymeric or chemical resin components.

Examples of cementious materials that may be used to form a cement slurry carrier fluid include those materials such as mixtures of lime, silica and alumina, lime and magnesia, silica, alumina and iron oxide, cement materials such as calcium sulphate and Portland cements, and pozzolanic materials such as ground slag, or fly ash. Formation, pumping, and setting of a cement slurry is known in art, and may include the incorporation of cement accelerators, retardants, dispersants, etc., as known in the art, so as to obtain a slurry and/or set cement with desirable characteristics. "Gunk" as known in the art refers to a LCM treatment including pumping bentonite (optionally with polymers or cementious materials) which will harden upon exposure to water to form a gunky semi-solid mass, which will reduce lost circulation. Polymeric-based LCM treatments may include any type of crosslinkable or gellable polymers. Examples of such types of LCM treatments may include VERSAPAC®, FORM-A-SQUEEZE®, FORM-A-SET®, EMI-1800, and FORM-A-PLUG® II, which are all commercially available from M-I LLC (Houston, Tex.).

In other embodiments, the settable carrier fluid may include pre-crosslinked or pre-hardened chemical resin components. As used herein, chemical resin components refers to resin precursors and/or a resin product. Thus, similar to cement, the components placed downhole must be in pumpable form, and may, upon a sufficient or predetermined amount of time, harden into a gelatinous or solidified structure. Generally, resins may be formed from a bi- or multi-component system having at least one monomer that may self- or co-polymerize through exposure to or reaction with a hardening agent which may include a curing agent, initiator, crosslinkant, catalyst, etc. One of ordinary skill in the art would appreciate that there is a multitude of resin chemistry that may be used to in embodiments of the present disclosure, and that the claims should not be limited to any particular type of resin, as the discussion below is merely exemplary of the broad applicability of various types of resins to the methods disclosed herein.

Chemical mechanisms that may be used in the setting of the settable carrier fluids of the present disclosure may include, for example, reaction between epoxy functionalization with a heteroatom nucleophile, such as amines, alcohols, phenols, thiols, carbanions, and carboxylates. Further, in one embodiment, the epoxy functionalization may be present on either the monomer or the hardening agent. For example, as described in U.S. patent application Ser. No. 11/760,524, which is herein incorporated by reference in its entirety, an epoxy-modified lipophilic monomer may be crosslinked with a crosslinkant that comprises a heteroatom nucleophile, such as an amine, alcohol, phenol, thiol, carbanion, and carboxylate. Conversely, in U.S. patent application Ser. No. 11/737,612, which is also herein incorporated by reference in its entirety, various monomer species, such as tannins, lignins, natural polymers, polyamines, etc, that may contain amine or alcohol functionalization, may be crosslinked with varies epoxides, etc. Other resins formed through epoxide chemistry may be described in U.S. Patent Application Ser. Nos. 60/939,733, and 60/939,727, which are herein incorporated by reference in their entirety. However, the present disclosure is not limited to reactions involving epoxide chemistry. Rather, it is also within the scope of the present disclosure that various elastomeric gels may be used, such as those described in U.S. Patent Application Ser. Nos. 60/914,604 and 60/942,346, which are herein incorporated by reference in their entirety.

When using a combination of a particulate- and settable-based treatment, the LCM carrier fluid may be a settable carrier fluid, such that the settable carrier fluid and bridging materials may be introduced into the wellbore as a "pill" and may be squeezed into a fracture and the bridging particulate material contained within the pill may bridge and seal the induced fractures at or near the mouth thereof. Use of such combination of particulate- and settable-based treatments to seal off fractures is described U.S. Patent No. 60/953,387, which is herein incorporated by reference in its entirety. The increased pressure may then be held while the pill sets, which may vary depending on the type of settable fluid used. Alternatively, a particulate-based treatment may be followed up with a subsequent, separate settable-based treatment.

Remedial Treatment

Lost circulation treatments may be applied as, for example, a spot application or a squeeze treatment, and constitute the majority of cases where lost circulation occurs. Generally, remedial treatments fall into two main categories, low fluid loss, where the fracture or formation is rapidly plugged and sealed, and high fluid loss where dehydration of the loss prevention material in the fracture or formations forms a plug that then acts as the foundation for fracture sealing, as described in detail above. Those of ordinary skill in the art will appreciate that depending on the specific drilling operation, a determination of whether fluid loss is low or high may be included in the initial determination of an appropriate remediation treatment to apply. However, in certain embodiments, such a determination may not be necessary due to known drilling data, such as wellbore lithology, that may provide information necessary to determine the treatment type/fluid loss control mechanism between a low fluid loss treatment and a high fluid loss treatment. For example, if drilling through an unconsolidated formation, a high fluid loss treatment may be preferable.

Referring to FIG. 1, a flow chart according to an embodiment of the present disclosure is shown. In this embodiment, a drilling engineer evaluates the drilling operation to determine whether the operation is losing fluid while drilling (STI). Fluid loss may be determined by monitoring fluid volume, such that when a drop in fluid volume occurs, a yes decision that the operation is resulting in losing drilling fluid (ST100) has occurred. If a no condition exists, indicating that no fluid loss is occurring, the drilling engineer may continue to drill ahead (ST101).

Based on certain aspects of the drilling operation, such as rate of penetration, torque on bit, revolutions per minute, etc., the determination of fluid loss (ST100) may occur at pre-selected intervals. For example, in one embodiment, a drilling engineer may check for fluid loss (ST100) at set time intervals, such as every 15, 30, or 60 minutes. In alternate embodiments, a drilling engineer may check for fluid loss (ST100) at selected depth intervals. In such an embodiment, a check for fluid loss (ST100) may occur, for example, in 25, 50, or 100 foot increments. In still other operations, a drilling engineer may check for fluid loss (ST100) when drilling switches between formation types or only when fluid volume loss is reported. Those of ordinary skill in the art will appreciate that offset well data may be used to predict areas that may result in fluid loss, and in such locations, more frequent fluid loss checks (ST100) may be performed.

After an initial determination that a yes condition exists, and fluid loss is occurring, the drilling engineer stops drilling and observes (ST102) the condition of the wellbore. By stopping and observing (ST102) drilling conditions, the drilling engineer may thereby determine whether fluid losses are surface or downhole losses (ST103). When determining whether fluid loss is a surface loss (ST103), drilling engineers should check all possible surface loss points, such as open valves, defective mud pumps, and cracked fluid line seals. If the floss loss is determined to be the cause of a surface loss, the drilling engineer should stop, locate, and fix (ST104) the cause of the surface loss. After resolving the surface loss, drilling engineer should proceed to drill ahead (ST101).

In certain embodiments, even after a surface loss has been determined to be the cause of the fluid loss, it may be beneficial to perform a fluid loss check (ST100) to verify that either the surface loss is resolved (ST104) or whether the loss is more than just a surface loss. For example, in certain embodiments, a drilling operation may be experiencing fluid loss that may be attributed to both surface and downhole loss. In such a situation, failure to perform timely subsequent fluid loss checks (ST100) may allow a fluid loss condition to remain untreated even after initial identification.

If the fluid loss is not determined to be a surface loss (ST103), thereby resulting in a no condition, the drilling engineer should proceed with measuring the rate of fluid loss (ST105). The measured rate of fluid loss (ST105) may thus include calculating the fluid loss rate at the drilling location. As described in detail above, the rate of fluid loss (ST103) may be classified based on a rate of fluid loss in cubic meters lost per hour. As illustrated, in this embodiment, the fluid loss is classified as either a seepage loss (ST106), a partial loss (ST107), or a severe/total loss (ST108). As described above, seepage losses include losses less than three cubic meters per hour, while partial losses include loses from three to ten cubic meters per hour, and severe/total losses are losses of greater than 10 cubic meters per hour.

Based on the measured rate of fluid loss (ST105) a drilling engineer then categorizes the fluid loss, and reviews a matrix of loss control material blends for the given fluid loss rate. For example, in one embodiment, a drilling engineer may measure the rate of loss (ST105) to be a seepage loss. For a seepage loss (ST106), the options for solving the fluid loss may include pumping one or more loss control blends (in this embodiment, one selected from three choices) downhole. Generally, seepage losses (ST106) take the form of slow losses, and can be in the form of filtration to a highly permeable formation. Additionally, seepage losses (ST106) may be confused with cuttings removal at the surface, and as such, during the measurement of a rate of fluid loss (ST105), a drilling engineer should consider whether a low measured rate of loss is actually a loss to cuttings removal.

As illustrated, for a seepage loss (ST106), a drilling engineer may be presented with several solutions for a loss control material to pump downhole, in this embodiment Blend #1 (ST106*a*), Blend #2 (ST106*b*), and Blend #3 (ST106*c*). Each blend may be pre-selected as an appropriate blend for a rate of loss classified as a seepage loss (ST106). For example, in one embodiment, blends (ST106*a-c*) may include a plurality of blends selected based on a determined fracture width and the type of fluid being used. In one embodiment, Blend #1 (ST106*a*) may include a blend of loss control material selected to seal fractures up to 1000 μm, while Blend #2

(ST106*b*) may include a blend of loss control material selected to seal fractures up to 1500 μm. In such an embodiment, Blend #3 (ST106*c*) may be selected to include an alternate blend of loss control material capable of sealing fractures of up to 150 μm.

In select embodiments, a drilling engineer may predict or estimate the fracture width of a segment of the wellbore, for example the risk zone, where fluid loss is believed to be occurring. The predicting may include using drilling or wellbore parameters and rock properties to determine an estimated fracture width, as described above. After the fracture width is predicted, optimal solution parameters, as well as optimal drilling fluid parameters for drilling ahead, based on the predicted fracture width may be determined. Examples of solution parameters may include loss control material size and concentration, while examples of drilling fluid parameters may include density, viscosity, rheology, and flow rate. In still other embodiments, predicting the fracture width may include using a rate of fluid loss and a hydraulic pressure in the loss zone to calculate the fracture width.

An alternative consideration that may be factored into the pre-selected blends is the type of fluid being used, for example, water-based or oil-based drilling fluids. As such, in one embodiment, Blend #3 (ST106*c*) may be a blend optimized for oil-based drilling fluids, while Blend #2 (ST106*b*) is optimized for water-based drilling fluids. Those of ordinary skill in the art will appreciate that the matrix of blend options and the specific fracture apertures for which the blends are optimized may vary according to specific parameters of the drilling operation. As such, a drilling engineer may optimize the blend matrix for a particular drilling operation by including blends that would resolve fluid loss recorded in, for example, offset wells. The specific solution selected for a particular drilling operation may be based at least in part on a severity of the loss, the type of drilling fluid used, the type of formation being drilling, the type and size of fracture, and the fracture gradient. The solution may also be selected based on secondary considerations known to those of ordinary skill in the art.

After one of blends (ST106*a-c*) is pumped downhole (i.e., the solution is implemented), the drilling engineer determines whether the blend was successful (ST109) in resolving the fluid loss. If the fluid loss is resolved, the drilling engineer may continue to drill ahead (ST101). However, if the blend did not resolve the fluid loss, the drilling engineer determines whether the measured rate of loss (ST105) is the same, has decreased, or has increased. If the measured rate of loss has remained the same, or is still classified as a seepage loss (ST106), the drilling engineer may repeat the selection of a blend, including either re-pumping the same blend, or selecting a new blend within the matrix. This process of measuring a rate of loss (ST105), selecting a blend, and determining a success of the blend (ST109) may be repeated until the measured rate of loss (ST105) falls within an acceptable range. In certain embodiments, the drilling fluid loss may be re-calculated after implementing the solution, and then the drilling fluid loss type may be re-classified based on the re-calculated rate of drilling fluid loss. In such an embodiment, the steps of re-calculating, re-classifying, and selecting a solution may be repeated until fluid loss reaches a target fluid loss (i.e., a fluid loss within an acceptable range).

In certain embodiments, the drilling engineer may determine that a more aggressive approach to solve the fluid loss is required. In such an embodiment, the drilling engineer may choose to use a blend from the partial loss (ST107) characterization, even though the measured rate of loss (ST105) may still be within the seepage loss (ST106) characterization. In still other embodiments, the drilling engineer may determine that even though the result of the blend success (ST109) was a no condition, the drilling operation should continue to drill ahead (ST101). Such a consideration may be applicable if the fluid loss is not enough to constitute a drilling problem, if is not economical to delay drilling, or if the drilling fluid being used is not cost intensive.

Similar to the selection of a blend for seepage losses (ST106), if a partial loss (ST107) is the characterized rate of loss, the drilling engineer may select a partial loss blend, such as Blend #1 (ST107*a*), Blend #2 (ST107*b*), or Blend #3 (ST107*c*). A partial loss (ST107) includes loses that are greater than seepage losses (ST106). Here, the cost of the fluid may become more crucial in the decision to drill ahead (ST101) or to find a solution to the fluid loss. However, drilling with partial losses (ST107) may be considered if the fluid is inexpensive and the pressures are within operating limits.

Correspondingly, a selected partial loss blend may then be pumped into the wellbore, and the success (ST111) of the blend may be determined. As described above, if the rate of loss decreased after use of the partial blend, the drilling engineer may drill ahead (ST101). However, if the blend was not successful, the drilling engineer may select (ST112) to either re-pump the same blend, pump a new blend, or try a blend in a different matrix, such as a severe/total loss (ST108) blend. Those of ordinary skill in the art will appreciate that the options available to a drilling engineer with respect to seepage losses (ST106) may also be available to a drilling engineer resolving partial losses (ST107). Thus, a drilling engineer may choose to drill ahead (ST101), even if the effectiveness of the partial losses blend (ST107*a-c*) is non-determinable.

Similar to the process of selecting seepage loss blends (ST106*a-c*) and partial loss blends (ST107*a-c*), a characterization of a severe/total loss (ST108) may result in the selection of a severe/total loss blend (ST108*a-c*). As such, the drilling engineer may select a severe/total loss blend, such as Blend #1 (ST108*a*), Blend #2 (ST108*b*), or Blend #3 (ST108*c*). The selected partial loss blend may then be pumped into the wellbore, and the success (ST113) of the blend may be determined. As described above, if the rate of loss decreased after use of the partial blend, the drilling engineer may drill ahead (ST101).

Unlike seepage losses (ST106) and partial losses (ST107), for severe/total losses (ST108), regaining full circulation is required. Thus, in most circumstances, only after well control is re-established, can the method of cutting losses be determined. As such, if the severe/total loss blends (ST108*a-c*) are not effective in re-establishing well control (ST113), a settable fluid (ST114) may be used. Settable fluids may be used to cure severe losses, and are typically set up under static or dynamic conditions, as described above. Those of ordinary skill in the art will appreciate that various types of settable fluids are known, however, due to time considerations for allowing the plug to set (e.g., more than 6 hours to set), avoiding the use of settable fluids, except during total losses, is generally preferred.

During the selection and implementation of any of the above described solutions, the selections and results of the implementation may be recorded. The recorded solutions, and the results of the solutions may be compared against the type of formation in which the solution was used, such that more accurate matrices of selectable solutions may be generated over time. Additionally, the recorded data may be used in subsequent wellbore planning operations, such that when later wellbores are drilling through like formation types, a drilling engineer may predict the types of fluid losses the drilling operation is likely to experience. Thus, the collected data from the selected solutions and implementations may be used as drilling data in characterizing alternative solutions.

Furthermore, in certain embodiments, the results of the solutions may be used to determine whether preventative treatments should be used on the current and/or future drilling operations. For example, if a drilling operation is experiencing consistent fluid loss, the drilling data may suggest stopping drilling and using a preventative method, such as continuous particle additions.

Figure 2:
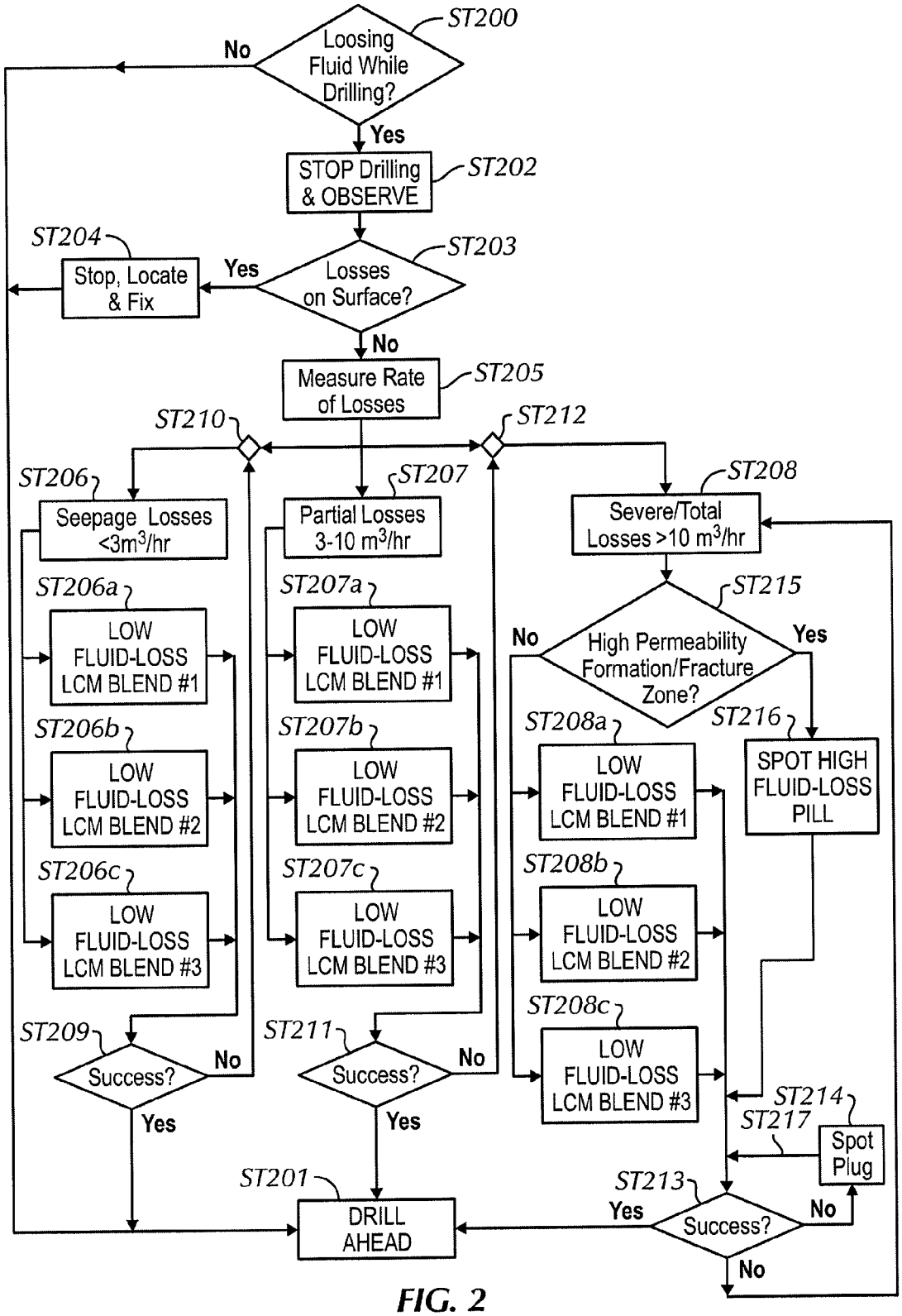
FIG. 2 is a flow chart of a method of remedial lost circulation treatment according to one embodiment of the present disclosure.

Referring to FIG. 2, a flow chart according to another embodiment of the present disclosure is shown. In this embodiment, a drilling engineer evaluates the drilling operation to determine whether the operation is losing fluid while drilling (ST200). If a no condition exists, indicating that no fluid loss is occurring, the drilling engineer may continue to drill ahead (ST201).

After an initial determination that a yes condition exists, and fluid loss is occurring, the drilling engineer stops drilling and observes (ST202) the condition of the wellbore. By stopping and observing (ST202) drilling conditions, the drilling engineer may thereby determine whether fluid losses are surface or downhole losses (ST203). If the floss loss is determined to be the cause of a surface loss, the drilling engineer should stop, locate, and fix (ST204) the cause of the surface loss. After resolving the surface loss, drilling engineers should proceed to drill ahead (ST201).

In certain embodiments, even after a surface loss has been determined to be the cause of the fluid loss, it may be beneficial to perform a fluid loss check (ST200) to verify that either the surface loss is resolved (ST204) or whether the loss is more than just a surface loss. For example, in certain embodiments, a drilling operation may be experiencing fluid loss that may be attributed to both surface and downhole loss. In such a situation, failure to perform timely subsequent fluid loss checks (ST200) may allow a fluid loss condition to remain untreated even after initial identification.

If the fluid loss is not determined to be a surface loss (ST203), thereby resulting in a no condition, the drilling engineer should proceed with measuring the rate of fluid loss (ST205). As described in detail above, the rate of fluid loss (ST203) may be classified based on a rate of fluid loss in cubic meters lost per hour. As illustrated, in this embodiment, the fluid loss is classified as a seepage loss (ST206), a partial loss (ST207), or a severe/total loss (ST208).

Based on the measured rate of fluid loss (ST205) a drilling engineer then categorizes the fluid loss, and reviews a matrix of loss control material blends for the given fluid loss rate. For example, in one embodiment, a drilling engineer may measure the rate of loss (ST205) to be a seepage loss. As illustrated, for a seepage loss (ST106), a drilling engineer may be presented with several solutions for a loss control material to pump downhole, in this embodiment Blend #1 (ST206*a*), Blend #2 (ST206*b*), and Blend #3 (ST206*c*). Each blend may be pre-selected as an appropriate blend for a rate of loss classified as a seepage loss (ST206). For example, in one embodiment, blends (ST206*a-c*) may include a plurality of blends selected based on a determined fracture width and the type of fluid being used. In one embodiment, Blend #1 (ST206*a*) may include a blend of loss control material selected to seal fractures up to 1000 μm, while Blend #2 (ST206*b*) may include a blend of loss control material selected to seal fractures up to 1500 μm. In such an embodiment, Blend #3 (ST206*c*) may be selected to include an alternate blend of loss control material capable of sealing fractures of up to 1500 μm.

In select embodiments, a drilling engineer may predict or estimate the fracture width of a segment of the wellbore, for example the risk zone, where fluid loss is believed to be occurring. The predicting may include using drilling or wellbore parameters and rock properties to determine an estimated fracture width, as described above. After the fracture width is predicted, optimal solution parameters, as well as optimal drilling fluid parameters for drilling ahead, based on the predicted fracture width may be determined. Examples of solution parameters may include loss control material size and concentration, while examples of drilling fluid parameters may include density, viscosity, rheology, and flow rate. In still other embodiments, predicting the fracture width may include using a rate of fluid loss and a hydraulic pressure in the loss zone to calculate the fracture width.

An alternative consideration that may be factored into the pre-selected blends is the type of fluid being used, for example, water-based or oil-based drilling fluids. As such, in one embodiment, Blend #3 (ST206*c*) may be a blend optimized for oil-based drilling fluids, while Blend #2 (ST206*b*) is optimized for water-based drilling fluids. Those of ordinary skill in the art will appreciate that the matrix of blend options and the specific fracture apertures for which the blends are optimized may vary according to specific parameters of the drilling operation. As such, a drilling engineer may optimize the blend matrix for a particular drilling operation by including blends that would resolve fluid loss recorded in, for example, offset wells. The specific solution selected for a particular drilling operation may be based at least in part on a severity of the loss, the type of drilling fluid used, the type of formation being drilling, the type and size of fracture, and the fracture gradient. The solution may also be selected based on secondary considerations known to those of ordinary skill in the art.

After one of blends (ST206*a-c*) is pumped downhole (i.e., the solution is implemented), the drilling engineer determines whether the blend was successful (ST209) in resolving the fluid loss. If the fluid loss is resolved, the drilling engineer may continue to drill ahead (ST201). However, if the blend did not resolve the fluid loss, the drilling engineer determines whether the measured rate of loss (ST205) is the same, has decreased, or has increased. If the measured rate of loss has remained the same, or is still classified as a seepage loss (ST206), the drilling engineer may repeat the selection of a blend, including either re-pumping the same blend, or selecting a new blend within the matrix. This process of measuring a rate of loss (ST205), selecting a blend, and determining a success of the blend (ST209) may be repeated until the measured rate of loss (ST205) falls within an acceptable range. In certain embodiments, the drilling fluid loss may be re-calculated after implementing the solution, and then the drilling fluid loss type may be re-classified based on the re-calculated rate of drilling fluid loss. In such an embodiment, the steps of re-calculating, re-classifying, and selecting a solution may be repeated until fluid loss reaches a target fluid loss (i.e., a fluid loss within an acceptable range).

In certain embodiments, the drilling engineer may determine that a more aggressive approach to solve the fluid loss is required. In such an embodiment, the drilling engineer may choose to use a blend from the partial loss (ST207) characterization, even though the measured rate of loss (ST205) may still be within the seepage loss (ST206) characterization. In still other embodiments, the drilling engineer may determine that even though the result of the blend success (ST209) was a no condition, the drilling operation should continue to drill ahead (ST201). Such a consideration may be applicable if the fluid loss is not enough to constitute a drilling problem, if is not economical to delay drilling, or if the drilling fluid being used is not cost intensive.

Similar to the selection of a blend for seepage losses (ST206), if a partial loss (ST207) is the characterized rate of loss, the drilling engineer may select a partial loss blend, such as Blend #1 (ST207*a*), Blend #2 (ST207*b*), or Blend #3 (ST207*c*). A partial loss (ST207) includes loses that are greater than seepage losses (ST206). Here, the cost of the fluid may become more crucial in the decision to drill ahead (ST201) or to find a solution to the fluid loss. However, drilling with partial losses (ST207) may be considered if the fluid is inexpensive and the pressures are within operating limits.

Correspondingly, a selected partial loss blend may then be pumped into the wellbore, and the success (ST211) of the blend may be determined. As described above, if the rate of loss decreased after use of the partial blend, the drilling engineer may drill ahead (ST201). However, if the blend was not successful, the drilling engineer may select (ST212) to re-pump the same blend, pump a new blend, or try a blend in a different matrix, such as a severe/total loss (ST208) blend. Those of ordinary skill in the art will appreciate that the options available to a drilling engineer with respect to seepage losses (ST206) may also be available to a drilling engineer resolving partial losses (ST207). Thus, a drilling engineer may choose to drill ahead (ST201), even if the effectiveness of the partial losses blend (ST207*a-c*) is non-determinable.

Similar to the process of selecting seepage loss blends (ST206*a-c*) and partial loss blends (ST207*a-c*), a characterization of a severe/total loss (ST208) may result in the selection of a severe/total loss blend (ST208*a-c*). If the characterization indicates that the loss is a severe/total loss (ST208), a determination (ST215) of the permeability of the formation/fracture zone may occur. If the formation/fracture zone is determined (ST215) to be a relatively high permeability zone, a high fluid-loss spot pill (ST216), such as FORM-A-SQUEEZE®, may be used to treat the fluid loss. However, if the formation/fracture zone is determined (ST215) to be a relatively low permeability zone, a severe/total loss blend (ST208*a-c*) may be used to treat the fluid loss.

If the formation/fracture zone is a relatively low permeability zone, the drilling engineer may select a severe/total loss blend, such as Blend #1 (ST208*a*), Blend #2 (ST208*b*), or Blend #3 (ST208*c*). The selected blend may then be pumped into the wellbore, and the success (ST213) of the blend may be determined. As described above, if the rate of loss decreased after use of the partial blend, the drilling engineer may drill ahead (ST201).

Unlike seepage losses (ST206) and partial losses (ST207), for severe/total losses (ST208), regaining full circulation is required. Thus, in most circumstances, only after well control is re-established, can the method of cutting losses be determined. As such, if the severe/total loss blends (ST208*a-c*) are not effective in re-establishing well control (ST213), a settable fluid (ST214) may be used. After the settable fluid (ST214) is used, an additional test (ST217) may be used to determine whether the treatment was effective in decreasing or preventing the fluid loss. If the settable fluid resolved the fluid loss condition, drilling may continue (ST201). If the additional test (ST217) indicates that the treatment was not effective (ST213), additional settable fluid (ST214) may be used, or the well may be abandoned.

Figure 3A:
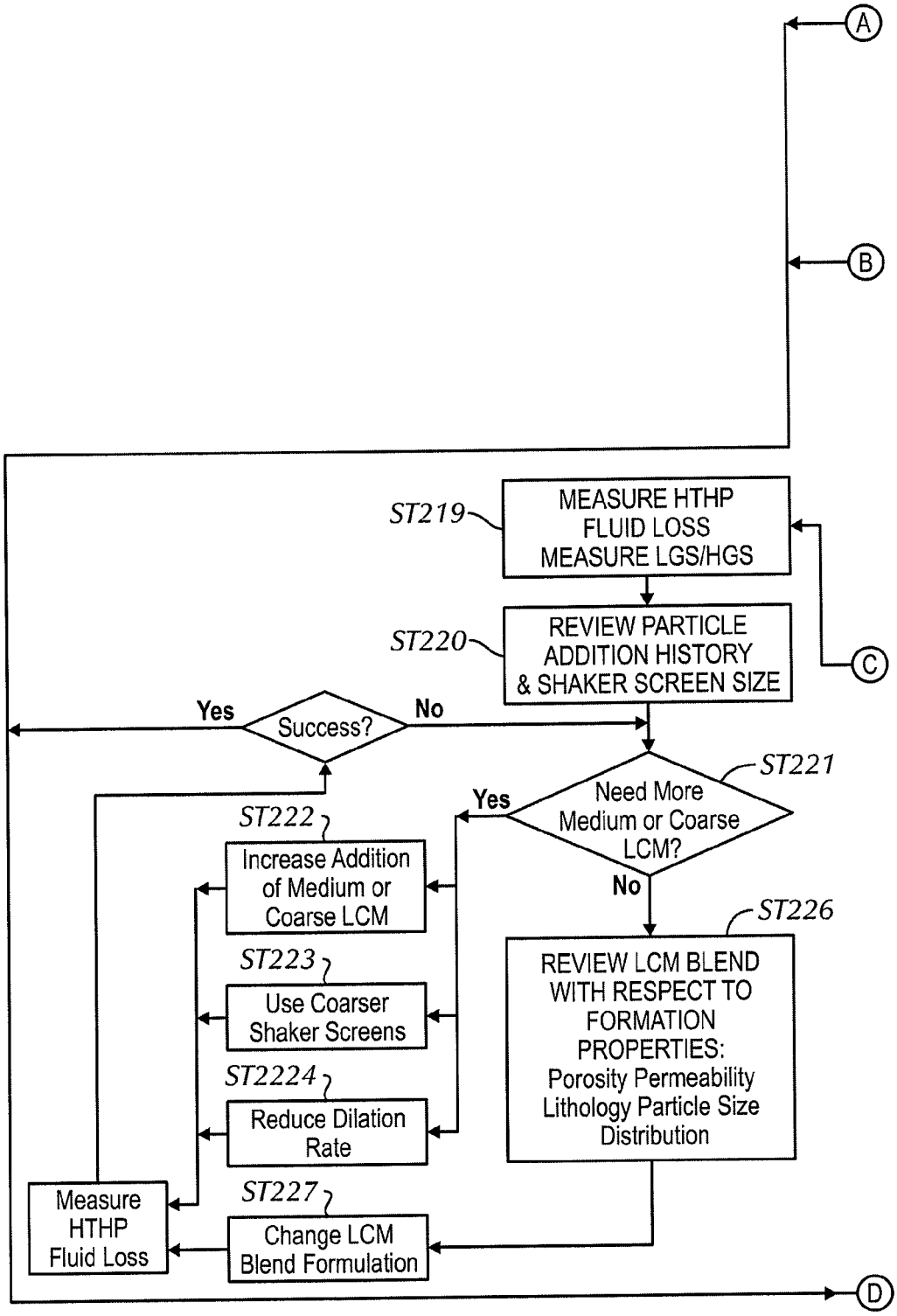
FIG. 3 is a flow chart of a method of remedial lost circulation treatment according to one embodiment of the present disclosure.
Figure 3B:
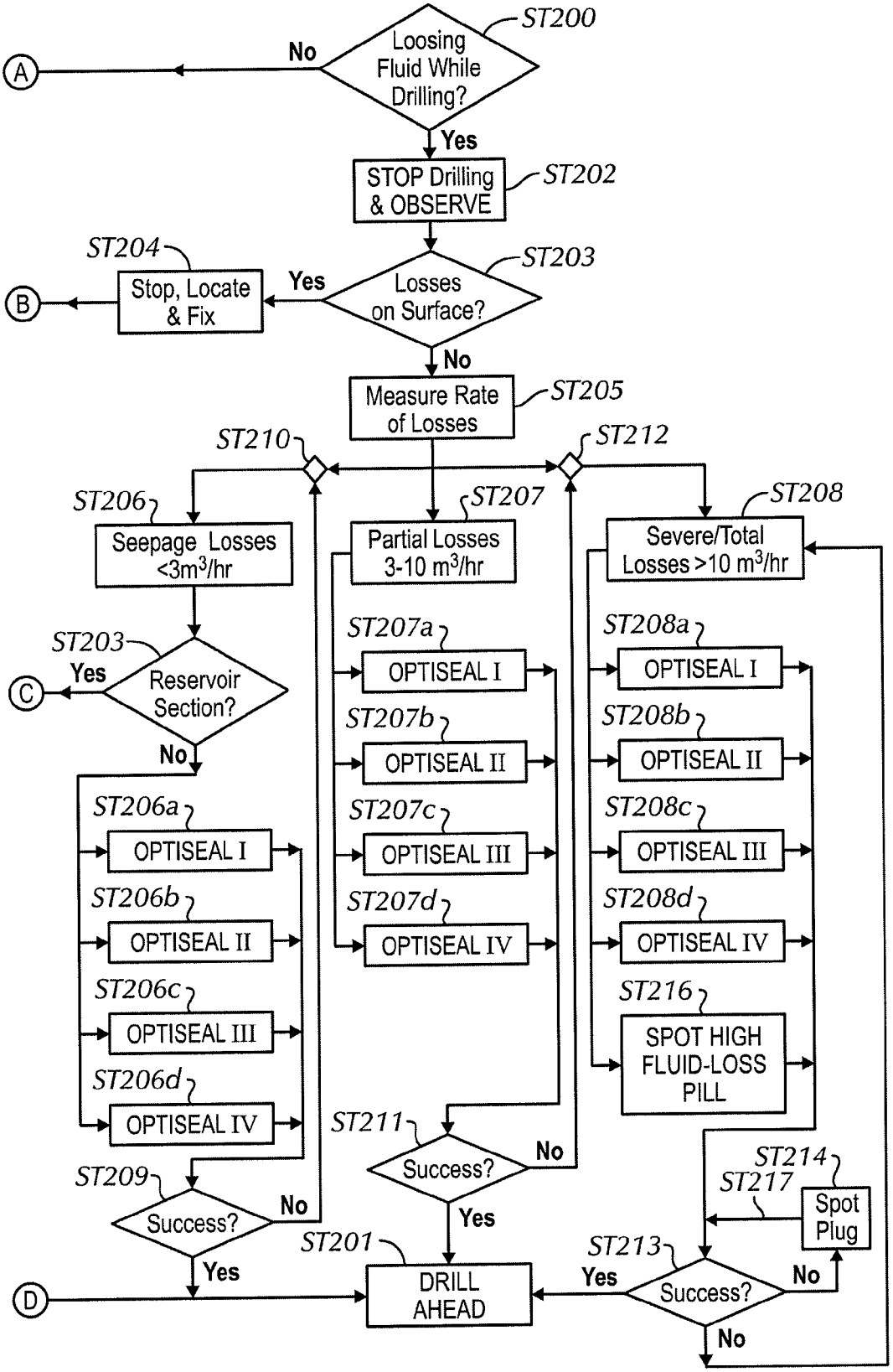

Referring to FIG. 3, a flow chart according to another embodiment of the present disclosure is shown. With respect to FIGS. 2 and 3, like character references indicate like processes. As such, steps ST200-ST217 with respect to FIG. 3 are not discussed in detail. FIG. 3 illustrates methods for remedial lost circulation treatment for seepage losses (ST206) that may include additional processes.

In this embodiment, after a characterization of the loss as a seepage loss (ST206), a second determination of whether the loss is occurring in a reservoir section (ST218) may occur. If the loss is not occurring in a reservoir section (ST218), the treatment process may occur with selection of a fluid loss blend, as described above. However, if the section is a reservoir section (ST218), then a secondary process may occur.

Seepage losses in reservoir sections (ST218) are generally controlled by any type of sized-LCM blends discussed above. For example, LCM concentrations for seepage loss control solids are typically in the range of 50 to 120 kg/m$^3$, while lower concentrations in the range of 50 to 80 kg/m$^3$ are used in heavier reservoir drill fluids or used in low to moderate permeability reservoirs (i.e., less than 350 mD). Higher concentrations of LCM (i.e., greater than 100 kg/m$^3$) are typically used where low-weighting-solid drilling fluids are used, or where the formation has a relatively high permeability (i.e., greater than 700 mD). The initial concentrations may contain a blend of fine, medium, and in certain operations, coarse solids.

After the determination that the loss is occurring in a reservoir section (ST218), the fluid loss and the low/high gravity solids content are measured (ST219). The measurement of the fluid loss may be performed at the surface using a high-temperature high-pressure test device ("HTHP"), as known to those of ordinary skill in the art. HTHP test devices typically include a container including a disc, such as a perforated ceramic disc, whereby a sample of the drilling fluid procured from the return flow of drilling fluid is placed into the container under a specified temperature and pressure, and then the amount of fluid passing through the disc is measured. Based on the amount of fluid that passed through the disc, the fluid loss downhole may be estimated. In addition to determining the downhole fluid loss, the particle addition history and vibratory separator screen size are determined (ST220). After the fluid loss and the low/high gravity solids content are known (ST219) and the separator screen size is determined (ST220) a determination of whether additional LCMs are required (ST221) is made. Typically, seepage losses in the reservoir section indicate that there is an insufficient concentration of bridging solids, or that the reservoir characteristics have changed.

If additional LCM is required, several options for increasing the LCM concentration are available. In certain aspects, additional LCM may be added (ST222), such that the concentration of medium and/or coarse LCM solids remains substantially constant. Another option includes using a coarser vibratory separator screen (ST223), thereby retaining a greater volume of medium and/or coarse LCM solids in the fluid being circulated. Still another option includes reducing the dilution rate while drilling (ST224), thereby increasing the overall concentration of the solids in the fluid being circulated. After one or more of the options to increase the LCM solids concentration occurs (ST222-ST224), the fluid loss is remeasured (ST225). If the fluid loss is now within an acceptable range, drilling may continue (ST201). However, if the fluid loss is not within an acceptable range, steps ST221-ST224 may be repeated, or the LCM blend may be reviewed with respect to the formation properties (ST226).

Reviewing the LCM formulation with respect to the formation properties (ST226) may include determining the formation porosity, permeability, lithology, and particle size distribution. Such properties may be determined by use of measurement while drilling and/or logging while drilling tools, as well as mud log data, that is typically available at the drilling rig site. After determining the formation properties, the LCM formulation may be adjusted (ST227) to decrease the reservoir fluid loss. After the formulation adjustment (ST227), the fluid loss may be remeasured (ST225), and additional determinations of increasing the LCM concentration may occur (ST221) or the LCM blend may be reformulated (ST226) if the fluid loss is not within an acceptable range. If the fluid loss is within an acceptable range after the LCM formulation adjustment (ST227), then drilling may continue (ST201).

Still referring to FIG. 3, in addition to providing a reservoir section analysis (ST218), FIG. 3 also illustrates that more than three blends of LCM for seepage losses (ST206), partial losses (ST207), and/or severe/total losses (ST208) may be used. As shown, LCM blends for treating a seepage loss (ST206) may include Blends ST206*a*-ST206*c*. Additional blends may also be used, such as Blend ST206*d*, which may include, for example, a fully acid soluble blend (e.g., calcium carbonate) in a specific concentration (e.g., 80 kg/m$^3$ or greater). Similarly, with respect to partial losses (ST207), a Blend ST207*d* may include, for example, a fully acid soluble blend of calcium carbonate in a concentration of 150 kg/m$^3$ or greater. Additionally, with respect to severe/total losses (ST208), blend ST207*d* may include, for example, a fully acid soluble blend of calcium carbonate in a concentration of 200 kg/m$^3$ or greater. Those of ordinary skill in the art will appreciate that other blends, as required for a particular operation may also be used. As such, in certain embodiments, a drilling engineer may select from more or less than four blends when determining a specific blend to use for a particular fluid loss characterization.

Preventative Treatment

When planning wellbores, one consideration when determining how to drill is the likelihood for fluid loss from the formation being drilled. As such, methods for planning a wellbore including preventative lost circulation treatment through continuous particle addition to the drilling fluid may be beneficial in preventing fluid loss. Planning the wellbore may initially include defining drilling data for drilling at least a segment of a planned wellbore. The segment may include, for example, a predetermined length, a specific formation, a time period, and a wellbore depth. Drilling data may include any data that may be used to plan wellbores, such as wellbore lithology, porosity, tectonic activity, fracture gradient, fluid type, fluid properties, hydraulic pressure, fluid composition, well path, rate of penetration, weight on bit, torque, trip speed, bottom hole assembly design, bit type, drilling pipe size, drill collar size, and casing location. Drilling data may include offset well data, experience data collected from similar drilling operations, or data such as that collected during prior remedial treatment operations.

After the drilling data is defined for a selected segment of a wellbore, a risk zone within the segment is identified. The risk zone may include an area of the wellbore segment where a fluid loss risk is identified. In certain embodiments, the risk zone may include substantial portions or even the entire wellbore segment, however, the size of the risk zone is only a consideration in determining whether to implement a solution, other factors include anticipated fluid loss within the risk zone, potential instability caused by the risk zone, and economic considerations. The lengths of an identified risk zone may generally include short or extended intervals, and may determine the method of implementing planned solutions.

In certain embodiments, multiple planned segments may be analyzed together, such that fluid loss and/or risk zones may be identified for large regions. Such planning may thereby allow a drilling engineer to determine whether short or extended interval solutions may be more beneficial for the entire drilling operations. For example, if a wellbore is divided into three 500 foot segments, and risk zones are identified in the first and third segments, but not in the middle segment, it may be more economical to continue a continuous particle addition treatment throughout drilling instead of changing drilling fluid parameters for the second segment.

Identification of the risk zone may also include comparing drilling parameters for the planned wellbore to offset well data, and determining based on the comparison, the risk zone for the planned wellbore. Those of ordinary skill in the art will appreciate that the prevalence for a risk zone may be at least partially determinative based on the type of drilling fluid being used. As such, by varying drilling parameters, including drilling fluid parameters, a risk zone may be avoided. Additionally, the occurrence of a risk zone may be caused by particular drilling parameters or drilling fluid parameters. For example, drilling through certain formation with incorrect pressures may result in fractured formation, thereby creating a risk zone, which may have otherwise been avoided. While it may be beneficial to compare the drilling parameters for the planned wellbore to offset well data, in other embodiments, the identification of a risk zone may be substantially based on wellbore lithology and formation parameters.

After the risk zone is identified for a particular segment, an expected fluid loss for the risk zone may be determined. The expected fluid loss may be based on the defined drilling data, which may include offset well data and/or data from remedial treatments in similar wells. In other embodiments, the expected fluid loss may include predicting an expected fracture width of the risk zone, such as using rock properties and drilling parameters to predict the fracture width. The fracture width may then be used to determine an expected fluid loss for the risk zone.

An expected solution to reduce fluid loss in the risk zone may then be selected. The specific solution selected may be based, at least in part, on the volume of expected fluid loss, the location of the fluid loss, the drilling parameters, the fluid parameters, and the predicted fracture width. In certain embodiments, the fracture width may be the dispositive factor in determining whether a continuous particle addition may be used as a preventative treatment. As explained above, a formation type that is likely to experience fluid loss may also be more susceptible to fracturing, thereby causing greater fluid loss, if incorrect sized fluid loss control particles and/or pressures are used. As such, those of ordinary skill in the art will appreciate that for preventative lost circulation treatments, high fluid loss treatments may be particularly beneficial.

Solutions may include the substantially continuous addition of loss control particles while drilling. The solution may include specified particle size distribution and concentration in the drilling fluid, typically, but not limited to, between 20 to 150 kg/m$^3$. Additionally, the particles additions should account for attrition and removal by vibratory shakers. The specific treatment used may also depend on the length of the interval to be drilled, as well as whether the particle addition will occur over a short or extended interval.

In one embodiment for a continuous particle addition while drilling a short interval, the loss control media may be added directly to the active pit or spotted at the drill bit. While drilling, the shaker screens may be either entirely bypassed, or alternatively, all except the scalping deck of a multiple deck vibratory separator may be removed. Thus, the loss control medial may be directly recycled and retained in the drilling fluid, thereby retaining a maximum amount of the loss control media. However, such a configuration may result in large volumes of cuttings in the active system, and while the cuttings may assist the loss control media, the cuttings may also result in higher fluid rheology, wear on pumps, wear on logging while drilling tools, and risk plugging logging while drilling tools. As such, in certain embodiments, it may be beneficial to predict an affect of the solution on a drilling tool assembly parameter, such as a components of the bottom hole assembly.

In another embodiment for a continuous particle addition while drilling an extended interval, it may be beneficial to use vibratory separators with a solids control system for adding and removing loss control media in circulation. By managing the particles in circulation, the rheology of the fluid may be controlled and cuttings may be removed from the system resulting in less wear to system components. However, depending on the loss control media used, large volumes of material may be lost to separation, and as such, greater inventory of loss control media will be required.

In certain embodiments, use of a pre-mixed loss control media may simplify the logistics of continuously adding material to the active system, as it may be easily bled into the fluid at the desired concentration. The use of such a pre-mix may also resolve logistics related to adding a fixed number of sacks of loss control media per time interval. Typically, continuous particle addition includes adding a fixed number of sacks of dry product to the circulating system per time interval. Such a process requires that the number of sacks and types of products added are matched to the circulation rate and the sizing of vibratory separator screens. Due to practical limits on the number of sacks that may be added per time interval, use of dry product may limit circulation rates, screen sizing, and maximum particle concentrations. As such, a solution may include a lost circulation treatment by maintaining a desired concentration of loss control media through the use of pre-mixed loss control media.

After the solution is selected, a drilling plan may be adjusted to account for the solution. In certain embodiments, a new drilling plan may be developed including the solution, as a result of the determination of the expected fluid loss, and to account for the identified risk zone. Thus, methods in accordance with the present disclosure may be used to plan new wells, or modify existing well plans. In certain embodiments, the planned wellbore may include a similar or identical well plan used in drilling an offset well. Thus, the analysis of the planned wellbore may include creating a new drilling plan based on the problems identified and/or associated with the planned wellbore. In other embodiments, the planned wellbore may include a general set of plans, such as drilling parameters, drilling location, and anticipated formation types. In such an embodiment, the identification, determination, and selection of a solution may result in the formation of a substantially new well plan.

In still other embodiments, the methods disclosed for preventative treatment may be used to optimize an existing well plan. For example, if a drilling operation following a planned well plan is experiencing fluid loss, and either does not want to employ remedial treatment, or if remedial treatment has been ineffective, drilling may be stopped, and a preventative approach may be adopted. As such, the determination of expected fluid loss may benefit from determining optimal drilling fluid parameters, including parameters related to loss control media, based on predicted fracture widths for the remainder of the drilling operation.

Figure 4A:
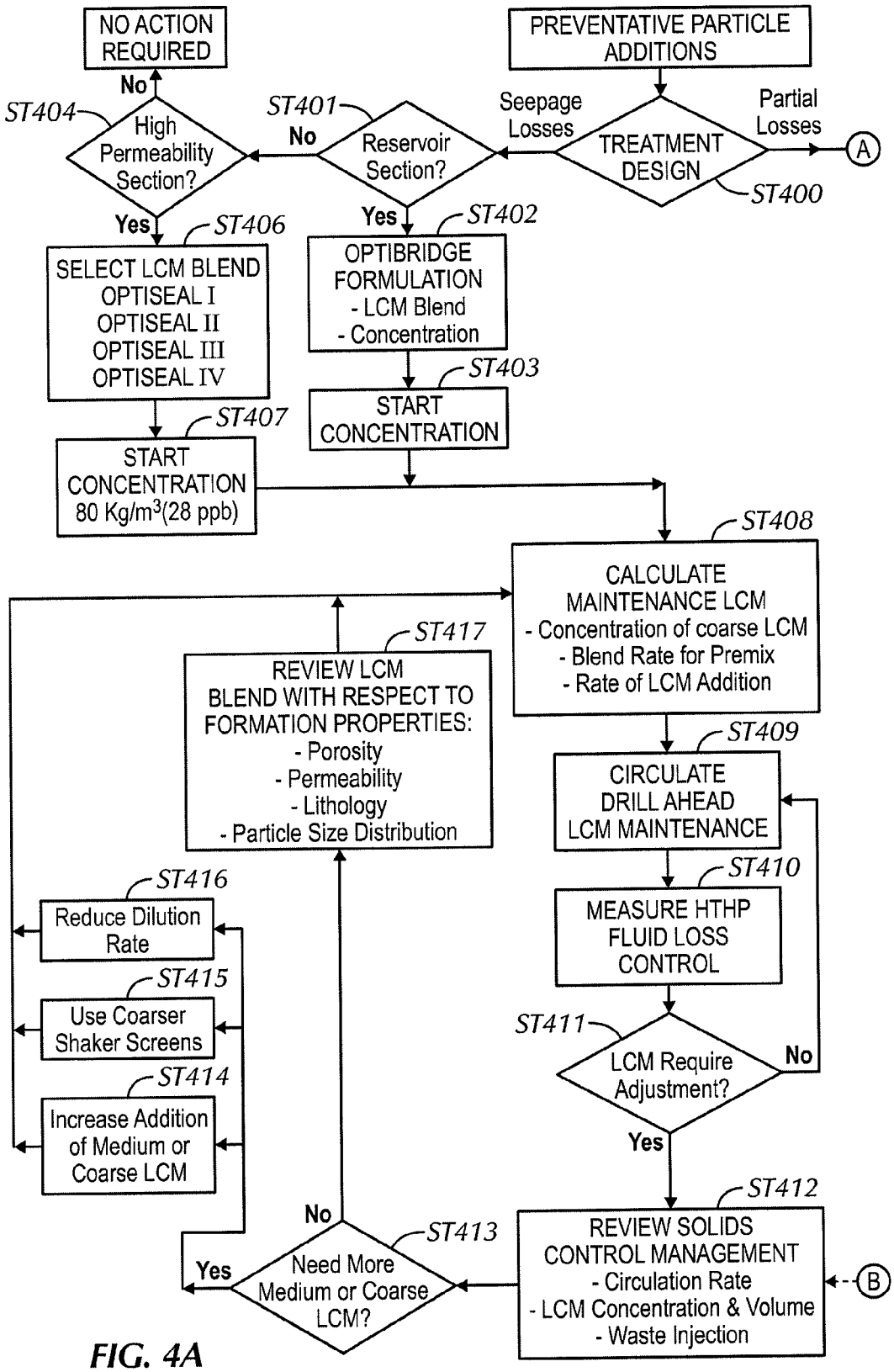
FIG. 4 is a flow chart of a method of preventative lost circulation treatment according to one embodiment of the present disclosure.
Figure 4B:
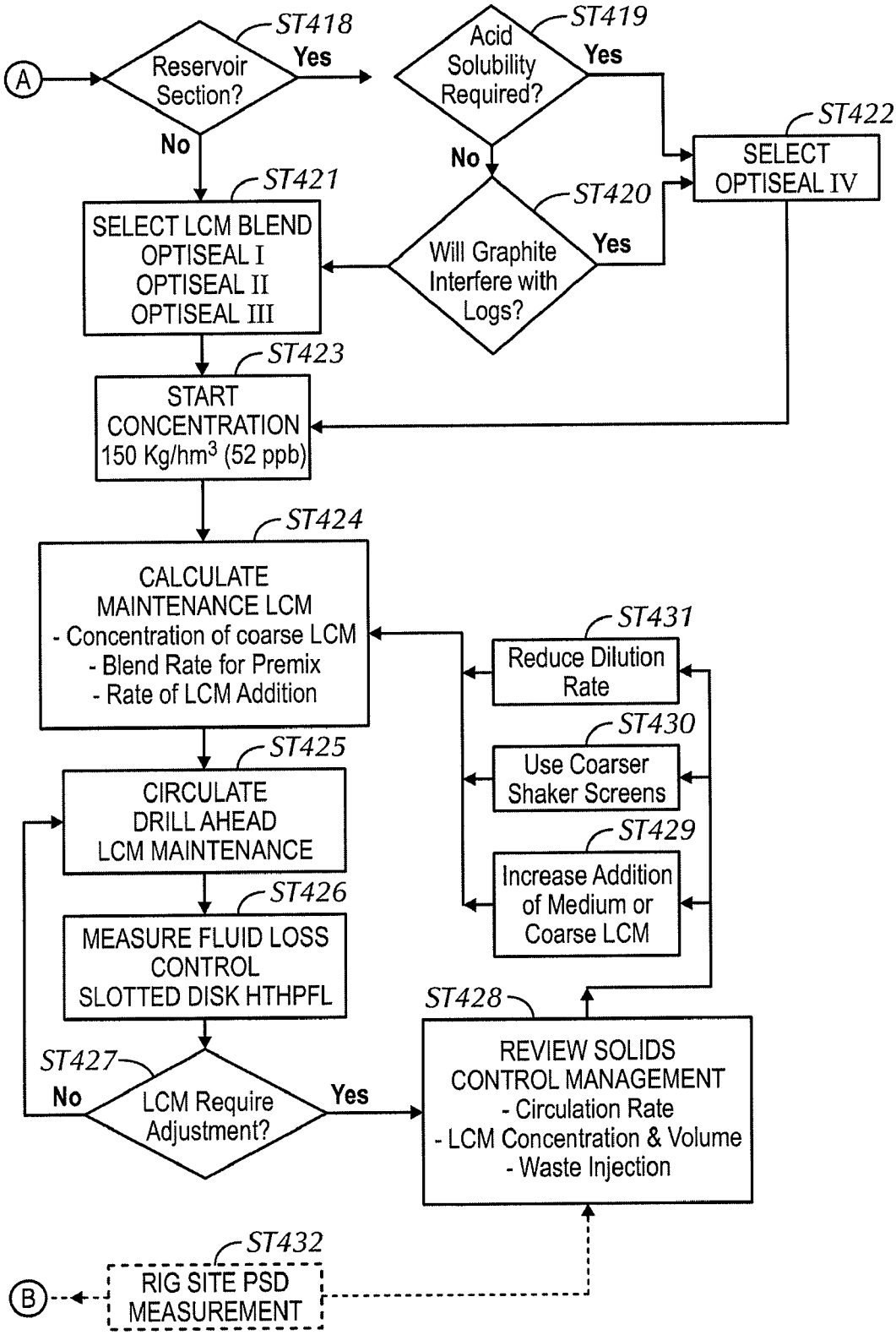

Referring to FIG. 4, a flow chart illustrating an example of a preventative lost circulation method is shown. Preventative lost circulation treatment is performed through continuous particle addition to the circulating drilling fluid. This method is commonly used for reservoir drilling fluids when adding LCM for seepage loss control. The method may be adapted when drilling through formations where partial to severe losses are known to occur or there is a high probability of such losses occurring (e.g. depleted reservoir formations). Initially, during the treatment design (ST400), a determination of whether the loss would likely be a seepage loss or a partial/severe loss occurs. If the loss is a seepage loss, then the drilling operator must determine whether the section being drilled is a reservoir section (ST401). If the section is a reservoir section (ST401), then a particular LCM formulation/concentration is determined (ST402), as described above, and the preventative LCM blend is added to the drilling fluid (ST403).

If the section of the wellbore being drilled is not a reservoir section (ST401), the drilling operator determines whether the section is a high permeability section (ST404). If the section is not a high permeability section (ST404), then no preventative action is required (ST405). However, if the section is a high permeability section (ST404), then an LCM blend is selected (ST406), such as blends ST206*a-d*, discussed above, and a particular concentration of the selected blend is added to the drilling fluid (ST407). In certain aspects, the concentration of the selected blend may be 80 kg/m$^3$, as discussed above with respect to the remedial treatments.

If the section of the wellbore being treated is either a high permeability section (ST404) or a reservoir section (ST401), the preventative treatment effectiveness may be measured during a maintenance calculation (ST408). The maintenance calculation may include determining the concentration of medium and/or coarse LCM solids in the fluid, as well as determining a rate of LCM addition to the fluid. After the amount of LCM required to continue the preventative treatment is determined (ST408), the LCM blend is continuously circulated while drilling (ST409), and regular measurements of fluid loss are taken (ST410). Those of ordinary skill in the art will appreciate that measurements of fluid loss may be performed with HTHP tests, as discussed above. In certain operations, regular measurements may include measurements taken hourly; however, in certain operations, regular measurements may be taken at other time intervals, such as every 6 hours.

After the rate of fluid loss is determined (ST410), the drilling operator determines whether the LCM blend requires adjustment (ST411). If the blend does not require adjustment, the process of monitoring the fluid continues (ST409-ST410). If the LCM requires adjustment (ST411), the drilling operator may review the solids control management (ST412) by, for example, determining the circulation rate of the fluid, determining the LCM concentration and volume, and analyzing the waste injection processes.

Based on the review of the solids control management (ST412), a determination of whether a greater volume of medium or coarse LCM solids are needed (ST413), may occur. If additional medium or coarse LCM solids are needed, additional LCM solids may be added (ST414), coarser shaker screens may be used on the vibratory separators (ST415), and/or the dilution rate may be reduced (ST4116), as explained above. After the LCM concentration is adjusted (e.g., using one or more of ST14-ST416), maintenance of the preventative particle additions may continue through regular LCM maintenance (ST408).

If, based on the review of the solids control management, the drilling operator determines that additional medium or coarse LCM solids are not needed (ST413), then the LCM blend may be reviewed with respect to the formation properties (ST417). The reviewed properties may include, for example, the formation porosity, permeability, lithology, and particle size distribution. With the updated formation properties and LCM blend review (ST417), the maintenance of the LCM may be recalculated (ST408).

Referring back to the initial treatment design selection (ST400), if the type of loss is determined to include either a partial or severe/total loss, a similar preventative methodology may be used. Initially, a drilling operator may determine if the section of the wellbore being drilled is a reservoir section (ST418). If the section being drilled is a reservoir section, then a determination of whether acid solubility is required may be performed (ST419). If acid solubility is not required then a determination of whether graphite will interfere with logging equipment (ST420), such as logging while drilling and/or measurement while drilling tools, may occur. If graphite will not interfere with the logging equipment, then a particular LCM blend is selected (ST421) based on the characteristics of the formation, as described in detail above. If graphite may interfere with the logging equipment or if acid solubility is required, an acid soluble LCM blend, such as Blend ST207*d*, above, may be selected (ST422).

After the blend is selected (ST421 or ST422), the blend is added to the drilling fluid (ST423), at a concentration of, for example, 150 kg/m$^3$. Similarly, if the wellbore section is initially determined to not include a reservoir section (at ST418), a drilling operator may select a blend (ST421), and add the blend to the drilling fluid (ST423).

After adding the preventative maintenance LCM blend to the drilling fluid, the preventative treatment effectiveness may be measured during a maintenance calculation (ST424). The maintenance calculation may include determining the concentration of medium and/or coarse LCM solids in the fluid, as well as determining a rate of LCM addition to the fluid. After the amount of LCM required to continue the preventative treatment is determined (ST424), the LCM blend is continuously circulated while drilling (ST425), and regular measurements of fluid loss are taken (ST426). As discussed above, the fluid loss may be measured at the surface using HTHP methods known in the art. In certain aspects, to more accurately reflect the fluid loss, the HTHP test may be performed using a slotted steel disc or a slotted ceramic disc.

After the rate of fluid loss is determined (ST426), the drilling operator determines whether the LCM blend requires adjustment (ST411). If the blend does not require adjustment, the process of monitoring the fluid continues (ST409-ST410). If the LCM requires adjustment (ST427), the drilling operator may review the solids control management (ST428) by, for example, determining the circulation rate of the fluid, determining the LCM concentration and volume, and analyzing the waste injection processes.

Based on the review of the solids control management (ST428), additional LCM solids may be added (ST429), coarser shaker screens may be used on the vibratory separators (ST430), and/or the dilution rate may be reduced (ST4131), as explained above. After the LCM concentration is adjusted (e.g., using one or more of ST429-ST431), maintenance of the preventative particle additions may continue through regular LCM maintenance (ST424).

During the review of the solids control management at either ST428 or ST412, additional information, such as rig site particle size distribution measurements may also be procured (ST432) from computer systems and/or networks at or remote from the drill site. In certain embodiments data in addition to a particle size distribution measurement may also be obtained and used in the review of the solids control management system (ST412 and ST428). Through effective solids control management (ST412 and ST428), particle size distribution and concentration of LCMs in the drilling fluid may be maintained, and preventative treatment may preempt the need for remedial treatments.

Figure 5:
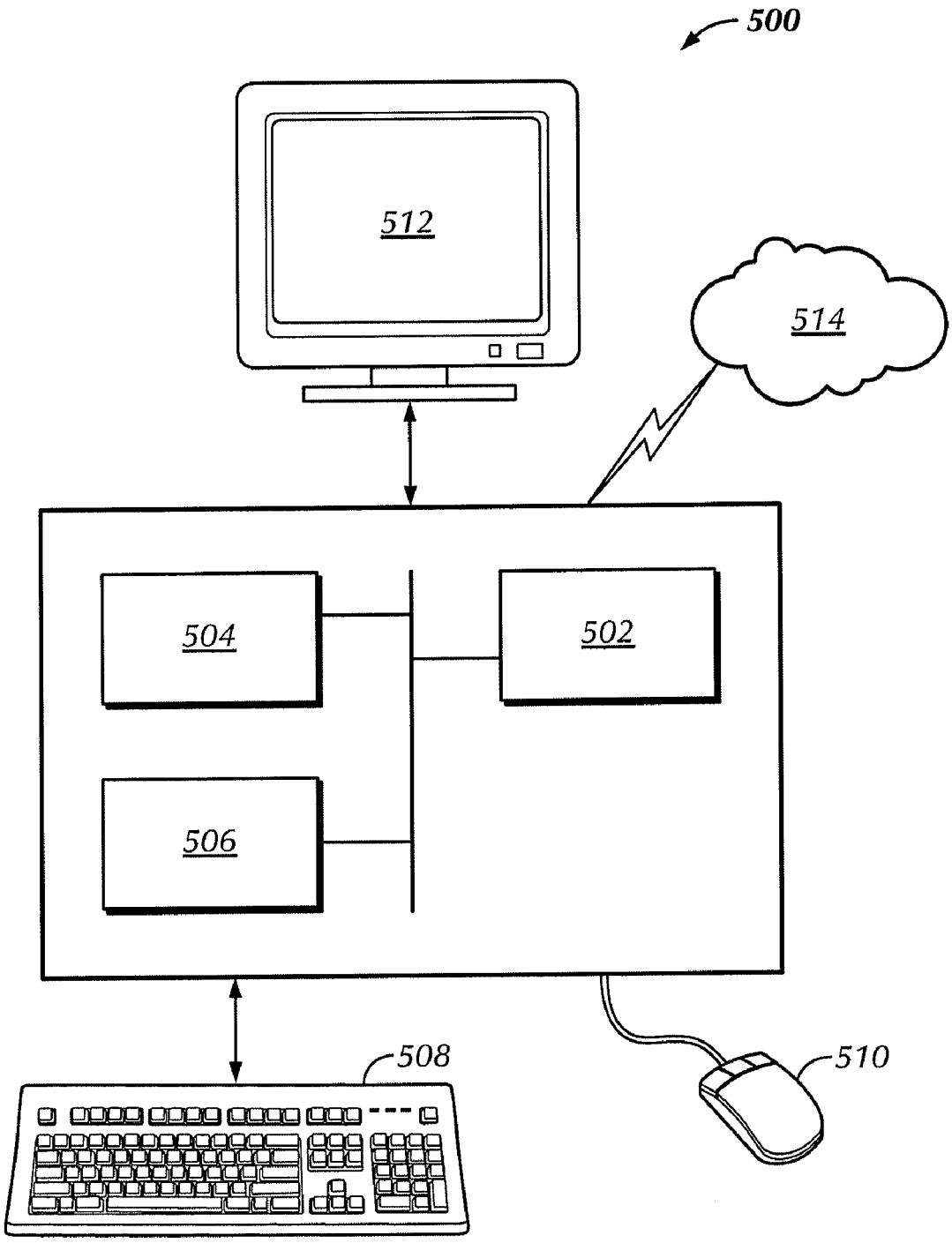
FIG. 5 is a schematic representation of a computer system according to one embodiment of the present disclosure.

Embodiments of the invention may be implemented on virtually any type of computer regardless of the platform being used. For example, as shown in FIG. 5, a computer system (500) includes one or more processor(s) (502), associated memory (504) (e.g., random access memory (RAM), cache memory, flash memory, etc.), a storage device (506) (e.g., a hard disk, an optical drive such as a compact disk drive or digital video disk (DVD) drive, a flash memory stick, etc.), and numerous other elements and functionalities typical of today's computers (not shown). The computer (500) may also include input means, such as a keyboard (508), a mouse (510), or a microphone (not shown). Further, the computer (500) may include output means, such as a monitor (512) (e.g., a liquid crystal display (LCD), a plasma display, or cathode ray tube (CRT) monitor). The computer system (500) may be connected to a network (514) (e.g., a local area network (LAN), a wide area network (WAN) such as the Internet, or any other similar type of network) via a network interface connection (not shown). Those skilled in the art will appreciate that many different types of computer systems exist, and the aforementioned input and output means may take other forms. Generally speaking, the computer system (500) includes at least the minimal processing, input, and/or output means necessary to practice embodiments of the invention.

Further, those skilled in the art will appreciate that one or more elements of the aforementioned computer system (500) may be located at a remote location and connected to the other elements over a network. Further, embodiments of the invention may be implemented on a distributed system having a plurality of nodes, where each portion of the invention may be located on a different node within the distributed system. In one embodiment of the invention, the node corresponds to a computer system. Alternatively, the node may correspond to a processor with associated physical memory. The node may alternatively correspond to a processor with shared memory and/or resources. Further, software instructions to perform embodiments of the invention may be stored on a computer readable medium such as a compact disc (CD), a diskette, a tape, or any other computer readable storage device.

Advantageously, embodiments of the present disclosure may allow for the remedial treatments of fluid loss during drilling. Particularly, remedial treatment may allow for the classification of drilling loss based on a measurement of the rate of fluid loss, and corresponding solutions for a given classification may be determined. The classification may thereby allow for more accurate solutions to drilling fluid loss to be identified and employed, decreasing costs associated with drilling.

Also advantageously, embodiments of the present disclosure may allow for preventative treatments for fluid loss to be used in drilling operations incurring fluid loss, as well as during wellbore planning. Preventative treatments may allow for solutions to fluid loss to be built into wellbore plans to decrease fluid loss during subsequent drilling. Additionally, preventative treatments may be used as on-the-fly modifications to drilling plans when unexpected formation types are encountered during a drilling operation. Thus, preventative treatment solutions may be used in both wellbore planning and re-planning existing wellbore plans during drilling.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A method comprising:

defining drilling data for drilling a segment of a planned wellbore;

identifying a risk zone in the segment;

determining an expected fluid loss volume for the risk zone; and selecting a solution to reduce fluid loss in the risk zone; and drilling the planned wellbore with a drill bit using the selected solution.

2. The method of claim 1, further comprising:

adjusting a drilling plan to include the solution.

3. The method of claim 1, further comprising:

creating a drilling plan comprising the solution.

4. The method of claim 1, wherein the identifying comprises:

comparing drilling parameters for the planned wellbore to offset well data; and determining, based on the comparing, the risk zone for the planned wellbore.

5. The method of claim 1, further comprising:

predicting a fracture width of the risk zone; and determining an optimal drilling fluid parameter based on the predicted fracture width.

6. The method of claim 5, wherein the predicting comprises using drilling parameters and rock properties to predict the fracture width.

7. The method of claim 1, further comprising:

predicting an affect of the solution on a drilling tool assembly parameter.

8. The method of claim 1, wherein the drilling data comprises at least one of wellbore lithology, porosity, tectonic activity, fracture gradient, fluid type, fluid properties, hydraulic pressure, fluid composition, well path, rate of penetration, weight on bit, torque, drag, trip speed, bottom hole assembly design, bit type, drill pipe size, drill collar size, and casing location.

9. The method of claim 1, wherein the solution comprises:

providing a lost circulation treatment.

10. The method of claim 9, further comprising:

maintaining the lost circulation treatment.

11. A method comprising:

calculating a drilling fluid loss rate at the drilling location from defined drilling data;

classifying the drilling fluid loss based on the drilling fluid loss rate;

selecting a solution based at least in part on the classifying; and treating the drilling fluid loss at the drilling location using the selected solution by pumping a wellbore fluid into the wellbore at the drilling location.

12. The method of claim 11, wherein the classifying consists of at least one of seepage, partial loss, total loss, severe complete loss, and underground blowout.

13. The method of claim 11, further comprising:

re-calculating the drilling fluid loss rate after implementing the solution; and re-classifying the drilling fluid loss based on the recalculated rate of drilling fluid loss.

14. The method of claim 13, further comprising:

repeating the steps of re-calculating, reclassifying, and selecting until the drilling fluid loss reaches a target fluid loss.

15. The method of claim 14, further comprising:

determining whether the fluid loss is a surface fluid loss or a downhole fluid loss.

16. The method of claim 13, further comprising:

selecting a second solution based at least in part on the re-classifying.

17. The method of claim 11, wherein the solution selected is based in part on at least one of a severity of the losses, a type of drilling fluid used, and a type of formation drilled, a fracture type, and a fracture gradient.

18. The method of claim 11, further comprising:

predicting a fracture width of the risk zone; and determining an optimal drilling fluid parameter based on the predicted fracture width.

19. The method of claim 18, wherein the predicting comprises using drilling parameters and rock properties to predict the fracture width.

20. The method of claim 18, wherein the calculating comprises using a rate of fluid loss and a hydraulic pressure in the loss zone to calculate the fracture width.

* * * * *